US006353706B1

(12) United States Patent
Bridges

(10) Patent No.: US 6,353,706 B1
(45) Date of Patent: Mar. 5, 2002

(54) OPTIMUM OIL-WELL CASING HEATING

(75) Inventor: Jack E. Bridges, Park Ridge, IL (US)

(73) Assignee: Uentech International Corporation, Calgary (CA)

( * ) Notice: Subject to any disclaimer, the term of this patent is extended or adjusted under 35 U.S.C. 154(b) by 0 days.

(21) Appl. No.: 09/696,254

(22) Filed: Oct. 26, 2000

Related U.S. Application Data

(60) Provisional application No. 60/166,199, filed on Nov. 18, 1999.

(51) Int. Cl.[7] ..... E21B 43/24; E21B 36/04

(52) U.S. Cl. ..... 392/306; 166/60; 166/302; 219/635; 219/643

(58) Field of Search ..... 392/306; 219/635, 219/643, 644, 656, 662; 166/60, 302

(56) References Cited

U.S. PATENT DOCUMENTS

| | | | | | |
|---|---|---|---|---|---|
| 48,584 | A | | 7/1865 | Parry et al. | |
| 1,184,649 | A | * | 5/1916 | Huff | 166/60 |
| 1,464,618 | A | | 8/1923 | Pershing | |
| 1,776,997 | A | * | 9/1930 | Downey | 392/306 |
| 2,302,774 | A | * | 11/1942 | Jarvis | 166/60 |
| 2,472,445 | A | | 6/1949 | Sprong | |
| 2,932,352 | A | | 4/1960 | Stegemeier | |
| 2,954,826 | A | * | 10/1960 | Sievers | 166/60 |
| 3,114,417 | A | | 12/1963 | McCarthy | |
| 3,207,220 | A | | 9/1965 | Williams | |
| 4,319,632 | A | | 3/1982 | Marr, Jr. | |
| 4,524,827 | A | | 6/1985 | Bridges et al. | |
| 4,704,514 | A | | 11/1987 | Van Egmond et al. | |
| 4,821,798 | A | | 4/1989 | Bridges et al. | |
| 5,621,844 | A | | 4/1997 | Bridges | |
| 6,112,808 | A | * | 9/2000 | Isted | 166/60 |

FOREIGN PATENT DOCUMENTS

| | | |
|---|---|---|
| CA | 2090629 | 12/1998 |
| CA | 2208197 | 12/1998 |

OTHER PUBLICATIONS

Homer Spencer, Nickles New Technology Magazine vol. 4, No. 2, Jun. 1998, pp. 627–631.

Electrical Heating of Oil Wells Using the Triflex Method Telsa Industries, 1998.

* cited by examiner

*Primary Examiner*—John A. Jeffery
(74) *Attorney, Agent, or Firm*—Cook, Alex, McFarron, Manzo, Cummings & Mehler, Ltd.

(57) ABSTRACT

An electrical heating method and apparatus for minerals wells having a metallic fluid admission section located adjacent a hydrocarbonaceous reservoir of a heterogeneous reservoir that has at least two longitudinally spaced producing intervals having different thermal heat transfer characteristic. The method includes providing a downhole electrically energized heater having at least two independently controlled heating elements spaced longitudinally apart from each other. At least one of the heating elements is positioned near a first of the producing intervals adjacent the fluid admission section. The second of the heating elements is positioned near a second of the producing intervals adjacent the fluid admission section. Electrical energy is supplied to each of the heating elements to increase the temperature of the producing interval near each of the heating elements where the temperature is measured adjacent each of the heating elements and the quantity of electrical power supplied to each of the heating elements is controlled in accordance with the thermal transfer characteristic of each of the producing intervals to realize a specific temperature need near each of the heating elements. The apparatus includes a downhole electrically energized heater having at least two independently controlled heater elements. Electrical conductors conduct a source of electrical energy located above the ground near the top of the well to the heater elements to independently supply energy to each of the heater elements. A temperature sensor is provided for each of the heater elements to measure the temperature adjacent each of the elements and a control is provided for varying the quantity of electrical energy to supply to each of the heater elements in accordance with a specific temperature near each of the heater elements.

22 Claims, 7 Drawing Sheets

80

Fig. 8
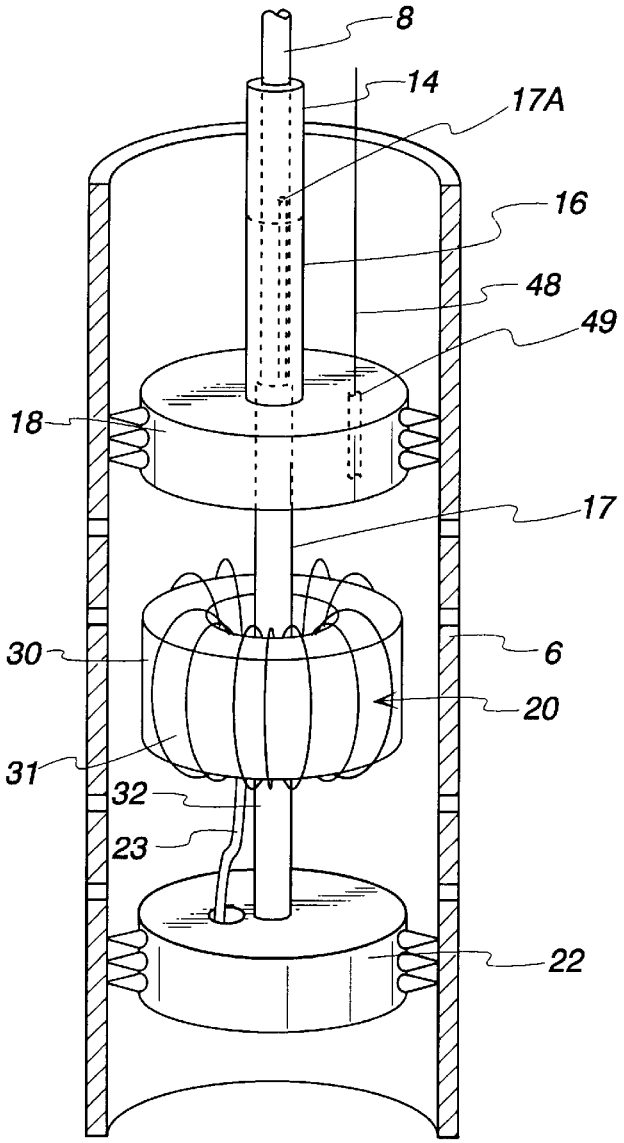
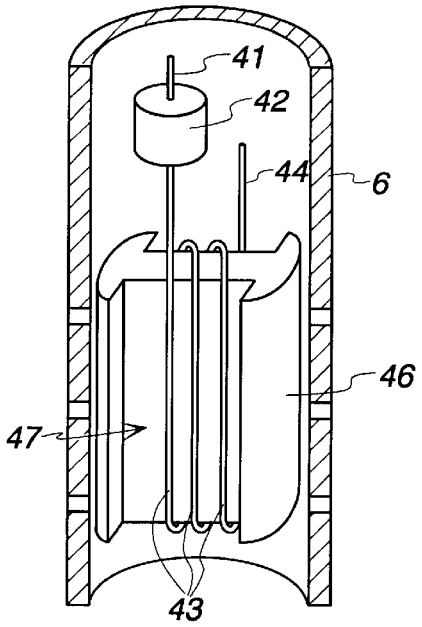
Fig. 10
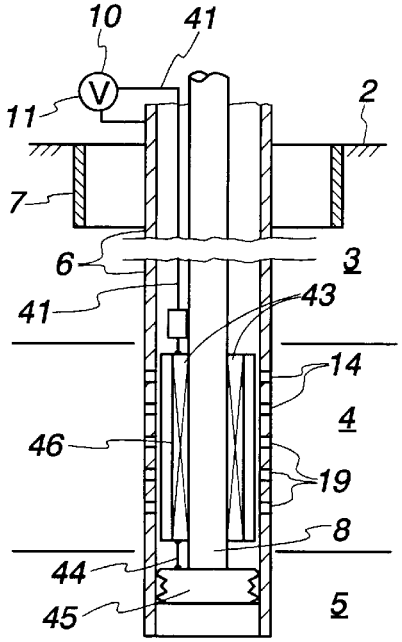
Fig. 11
31

30

32

80

OPTIMUM OIL-WELL CASING HEATING

This application claims the benefit of provisional application Ser. No. 60/166,199, filed Nov. 18, 1999.

BACKGROUND OF THE INVENTION

Major problems exist in producing oil in heavy-oil reservoirs because of the high viscosity of the oil. Because of this high viscosity oil, a very high pressure gradient builds up around the wellbore, thereby utilizing almost two-thirds of the reservoir pressure in the immediate vicinity of the wellbore. Furthermore, as the heavy oils progress inwardly to the wellbore, gas in solution evolves more rapidly into the wellbore. Since the dissolved gas reduces the viscosity, this evolution further increases the viscosity of the oils in the immediate vicinity of the wellbore. Such viscosity effects, especially near the wellbore, greatly impede production, and the resulting wasteful use of reservoir pressure can reduce the overall primary recovery from such reservoirs.

Similarly, in light-oil deposits, dissolved paraffin in the oil tends to accumulate around the wellbore, particularly in the screens and perforations and within the deposit up to a few feet from the wellbore. This precipitation effect is caused by the evolution of gases and volatiles as the oil progresses into the vicinity of the wellbore, thereby decreasing the solubility of paraffin and causing it to precipitate. Also, the evolution of gases causes an auto-refrigeration effect which reduces the temperature, thereby decreasing the solubility of the paraffins. Similar to paraffin, other condensable constituents can also plug up, coagulate, or precipitate near the wellbore. These include gas hydrates, asphaltenes, and sulfur. In the case of certain gas wells, liquid distillates can accumulate in the immediate vicinity of the wellbore. Such accumulation reduces the relative permeability near the wellbore. In all such cases, such near wellbore accumulations reduce production rates and reduce ultimate primary recoveries.

Electrical resistance heating has been employed to heat the reservoir in the immediate vicinity of the wellbore. This has been the subject of recent pilot tests. Basic systems are described in Bridges U.S. Pat. No. 4,524,827 and in Bridges et al., U.S. Pat. No. 4,821,798. Such systems are applicable largely for new wells. Prior to installation, some modifications of casing near the wellbore are usually needed to permit electrical resistance heating in the reservoir near the wellbore. For a cased-hole completion, the electrode which is in the reservoir must be isolated from the casing by fiberglass tubing above and below the electrode as discussed in Bridges et al., U.S. Pat. No. 4,821,798.

In the case of open-hole completions, considerable modification of the downhole screen and near reservoir casing and tubing is required. For existing wells, the old gravel pack and screens must be removed and a new gravel pack and screen system installed so that an electrically isolated electrode can be positioned in the deposit. Such electrode may be part of the gravel pack and screening system.

Such near wellbore heating systems have been demonstrated to massively heat the reservoir just outside the wellbore and to reduce or eliminate many of the aforementioned thermally responsive flow impediments. Such elimination can result in demonstrated flow increases of 200 to 400%. These procedures are used primarily in new well installations for cased-hole completions, but can be also used for either new open-hole completions or to retrofit existing wells with open-hole completions.

However, open-hole modifications are largely limited to either new wells or existing wells that have a very high flow rate, because the cost of installing either a new well or repacking an existing open-hole completed well with a new electrode assembly and gravel pack system is large.

What is desired, then, is a method of retrofitting old wells, either cased or open-hole completions, which is inexpensive and yet heats some of the reservoir in the immediate vicinity of the wellbore adjacent to the formation as well as within the wellbore itself. One method of doing this has been attempted before with a mixed degree of success. This technique employs the use of cylindrical resistance heaters which are coaxially situated in the wellbore and are positioned in the wellbore immediately adjacent to the reservoir. The earliest patent in the literature on this subject matter was issued in July of 1865 in U.S. Pat. No. 48,584 which is described as an electric oil well heater. Since then, numerous patents have been issued which have covered this type of inside wellbore heating. Such past art includes Pershing U.S. Pat. No. 1,464,618, Stegemeier U.S. Pat. No. 2,932,352, McCarthy U.S. Pat. No. 3,114,417, Williams U.S. Pat. No. 3,207,220 and Van Egman et al., U.S. Pat. No. 4,704,514. Such systems, heating inside the wellbore, received considerable attention in the 1950's and early 1960's, with some improvements reported in some reservoirs and other reservoirs showing mixed results. One principal difficulty encountered with such heaters was that they burned out at intervals so frequent that their use could not be justified. Though some of the causes of the failure of these resistors were due to poor designs, some fundamental problems also exist which contributed to the burn-out problem.

The useful heat supplied by the cylindrical resistor flows out of the wellbore and into the formation by thermal conduction. At the same time, unavoidably, the flow of fluids inwardly into the wellbore removes, via convection, transfers heat transferred by convection from the formation toward the producing well. In the wellbore itself, the heat is further unavoidably removed from the annular space between the heater and the screen or casing, via convection caused by the upward flow of oil in the well. Therefore, in order to achieve a noticeable increase in temperature just outside of the wellbore, very high heater temperatures were required. Such higher heater temperatures may also be accompanied by the deposition of scale or products of low temperature pyrolysis on the heater. This further thermally isolates the heater, thereby causing requirements for even higher resistor temperatures, which further compounds the problem. As a consequence of this fundamental counter flow heat problem between outward thermal diffusion and inward thermal convection, such an approach would be effective only in slowly producing wells and would become decreasingly less effective as the flow rate was increased much above a few tens of barrels per day for typical installations.

One method to mitigate the aforementioned problem would be to create a situation such that the casing itself, in the completed zone, would provide the heat. Alternatively, for an open-hole completion, the screen and/or gravel pack might preferably provide the heat rather than a small diameter cylindrical resistor element coaxially located within the wellbore next to the producing zone. By so doing, the radius of the heat producing element or resistor could be extended from approximately 1 in. to about 8 in., depending on the diameter of the wellbore or screen in the completed zone. Such an arrangement would give at least a fourfold improvement in the amount of heat which could be transferred based on a given temperature of the heated element. In addition, such an arrangement would eliminate in the annulus convection heat losses in the annulus due to the upward thermal convection of the fluids once they entered into the wellbore itself.

Earlier techniques have been ineffectively addressed in two U.S. patents; 1) by A. W. Marr in U.S. Pat. No. 4,319,632 and 2) by S. D. Sprong in U.S. Pat. No. 2,472,445. In either case, no system is adequately described which embodies the use of such casing heating systems and which is combined with an efficient downhole power delivery and control system. For example, in the case of Marr, the electrical heating system had one electrical contact with the casing at the surface and the other contact in the producing zone. As a consequence, current flowed from the bottom of the casing up along the entire surface, thereby heating the entire casing string and adjacent formations. Such a system is quite inefficient, especially if high temperatures are desired. In the case of Sprong, the system heated the casing by use of an induction eddy-current type heating applicator. However, the applicator as described had a large air gap between the applicator and the casing and, as a consequence, the reactive or inductive component was large, thereby creating a low power factor load on the power cable delivery system. Such low power factors result in inefficient delivery of power.

For aboveground equipment, any low power factor load which has modest power consumption (e.g., a few tens of kilowatts), and which is paired with high power factor higher power systems does not pose a problem. However, it is not readily recognized that delivering power over a half mile distance to a downhole load with a low power factor does represent a major power delivery problem and can result in cable overheating losses, cable breakdown, and other undesirable problems, especially if loads are in the order of tens of kilowatts or more. It also represents a less efficient method of power delivery.

Marr and Sprong do not address the issue of choosing operating parameters and the required additional subsystems or operation conditions that permit efficient power delivery. Such operating parameters include proper selection of the electrical waveform or frequency or proper locating and design of the casing wall heating tool. Additional subsystems (which may include a downhole matching network and control apparatus) are needed to prevent formation damage due to deposition of pyrolysis products of the incoming liquids in the immediate vicinity of the borehole and especially on the screens or perforations.

More recently, one patent has issued that remedies many of the difficulties with Matt and Sprong by Bridges, (Canadian Patent 2,090,629, issued Dec. 29, 1998) Electrical Heating System for Low-Cost Retrofitting of Oil Wells). This patent describes two generic casing heating systems, one that uses induction heating apparatus to heat the casing or screen by eddy-current effect and one that uses direct ohmic heating of the casing or screens. This latter approach uses a pair of contactors to supply heating current to a section of perforated casing or screen in the pay zone. To enhance power delivery efficiency, a downhole transformer is used to transform the very low impedance of the heated segment to a value much larger that the series impedance to the power delivery system.

Over the last few years, others* have developed and field tested an eddy-current current casing system very similar to that described by Bridges. (* Method and Apparatus for Subterranean Thermal Conditioning, Robert Isted, a published Canadian patent application No. 2208197, Electrical Induction Heating of Heavy Oil Deposits Using the Triflux System, by Homer Spencer, Nickles New Technology Magazine, Vol. 4, No. 2. June 1998 pp. 627–630, and Electrical Heating of Oil Wells Using the Triflux Method. Tesla Industries, 1998). Similar to that described by Bridges, the Isted/Spencer apparatus consists of a long, small-diameter, eddy-current heating coil that is positioned within the casing or screen that are within the pay zone. Each of these small diameter coils are stacked longitudinally on a single axis in groups of three, presumably to take advantage of a three phase 60 Hz power supply or to use existing three conductor armored cables. Each of the three coils is provided with a temperature sensor, but only one of the temperature sensors is used to control the heating. The three coils are packaged to withstand the bottom hole pressures. A downhole pressure sensor is also provided. A power conditioning unit is used to generate power in a suitable format under the control of the single downhole temperature sensor. Typical lengths of one or more groups of three coils are reported to range from 10 meters to 20 meters.

However, neither the Bridges or the Spencer/Isted apparatus or methods adequately account for the effects of heterogeneity found in typical deposits. While Spencer/Isted states "The principal control strategy is to maintain a constant temperature in the wellbore annulus in the vicinity of the inductors as measured by several temperature sensors deployed in the inductor assembly" but they do not provide the means to do so. For example they further state ". . . the Triflux System heats quite evenly over the entire length and surface of the target interval." Additionally they note, "The main function of the PCU (Power Conditioning Unit) is to control the power input to the well by maintaining a constant temperature at one of the selected temperature sensors on the tool."

While not obvious, the above implementation of their strategy doesn't lead to optimum operation. For example, consider a 3-meter pay zone that is to be heated by the above described casing/screen heating system. Past studies have shown that about 5 kW are needed to increase the temperature of one barrel of oil by 100° F. For this example, we will only consider this energy to just raise the temperature of the oil, although additional energy will be expended over time to heat the formations very near the wellbore. Assume that over the length of the pay zone, a highly permeable 1-meter section exists near the bottom of the pay zone and that this zone will produce one barrel per hour by dissipating 5 kW per hour in the casing. This raises the temperature of both the casing and produced liquids by 100° F. For simplicity assume that almost all of the production comes from this highly permeable region of the reservoir. However, to expend 5 kW within the casing near this highly permeable zone, an additional 10 kW will be expended in the upper 2-meters of the casing that is in low production zone. This occurs because the tool uniformly heats the casing throughout the pay zone. In this upper 2 meter section, the liquid that flows into the annulus from the reservoir is very small so that most of the 10 kW of heating will substantially increase the temperature of the liquids that are progressing upwards in the annulus of the casing from the permeable zone. One of two effects may take place: if a single, temperature-controlling sensor is near the top of the casing, the permeable zone will be under heated, and, therefore, only minimal stimulation benefits will occur. If a single, temperature-controlling sensor is located near the permeable zone, the upper part of 3 meter section will be overheated, and this excessive heating may cause premature failure of the eddy-current heating tool.

The above discussion neglects the energy that is lost to raise the temperature of the adjacent formations, especially where little or no liquid flows into the bore hole. This effect would temporally mitigate the excessive heating near the upper part of the bore hole when most of the production is from the lower section.

STATEMENT OF THE INVENTION

As opposed to the strategy of uniformly heating the casing across its entire span, a new strategy is needed to remedy the difficulties inherent with such uniform heating. A combination of several new criteria will be needed, especially after the initial warm up period:

(A) The spatial distribution of the temperature along the perforated casing should be uniform and not exceed a predetermined safe or economical value. The temperature should be limited so as to not degrade the heating tool or oil well completion components. Also, depending on the reservoir, operating at maximum safe operating temperature may not always result in the greatest cost benefit. As given in the preceding example, uniform heating (energy dissipation) along the casing heating tool will not generally achieve these goals.

(B) A practical alternative to (A), the spatial distribution of the temperature along the heating tool should be uniform and not exceed a safe or economical value.

(C) The spatial distribution of the heating (energy dissipation) along the perforated casing in the pay zone should be approximately proportional to the spatial distribution of the ingressing liquids along the perforated casing.

(D) The energy dissipation should also be proportional to the heat required to raise the temperature of a unit volume of produced liquids to a specified amount. For example, liquids with a high water content will require more energy than liquids with a very small amount of water.

(E) In reservoirs which have multiple producing zones that are separated by barren zones, the above criteria must be separately applied to each of the producing zones.

To realize the above criteria will require: (A) segmenting the casing heating functions of the tool into lengths that are smaller than the entire length of the perforated casing, (B) measuring the temperature near each of the segmented lengths, (C) controlling the dissipation of energy in each of the casing segments such that the maximum safe or economic temperature is not exceeded and (D) providing apparatus that permits control of the heating in terms of a specified preferred uniform or otherwise predetermined casing temperature profile.

Alternatively, the thermal heat transfer from or into the deposit near a segment can be calculated and used to simplify the design. Assuming that good reservoir data is available, the heat flows and temperatures near each segment can be calculated for a given thermal input. This calculation can be done by digital simulation programs that combine the electrical heating effects with reservoir analysis. One example of such a program is STARS that was evolved from a thesis by A. D. Herbert [entitled: "Numerical simulation of electrical preheat and steam drive bitumen recovery process for the Athabasca oil sands, Department of Electrical Engineering, University of Alberta, 1986]. The reservoir portion of such programs considers the spatial distribution of the pore volumes in the reservoir, the oil saturation of the pore volumes, the viscosity of the oil, the relative permeability of the pore volumes, the reservoir pressure, gas saturation, over burden pressure, the thermal conductivity, the heat capacities and the convection of heat. The electrical portion considers the spatial distribution of the electrical conductivity and the power dissipation of electrical energy in the reservoir or in the casing. The resulting calculations include the spatial temperature distribution and production of fluids in response to the electrical heating. Also included are the heat transfers into and out of the formation.

BRIEF DESCRIPTION OF THE DRAWINGS

FIG. 8 is a three-dimensional characterization of the downhole ohmic current system;

FIG. 10 illustrates the conceptual design of an eddy-current type downhole casing heating system comprising another embodiment of the invention;

FIG. 11 is a vertical section view of an eddy-current downhole casing system wherein the characteristics of the eddy-current exciter are matched to the characteristics of the cable and power source;

DESCRIPTION OF THE PREFERRED EMBODIMENT

Figure 1:
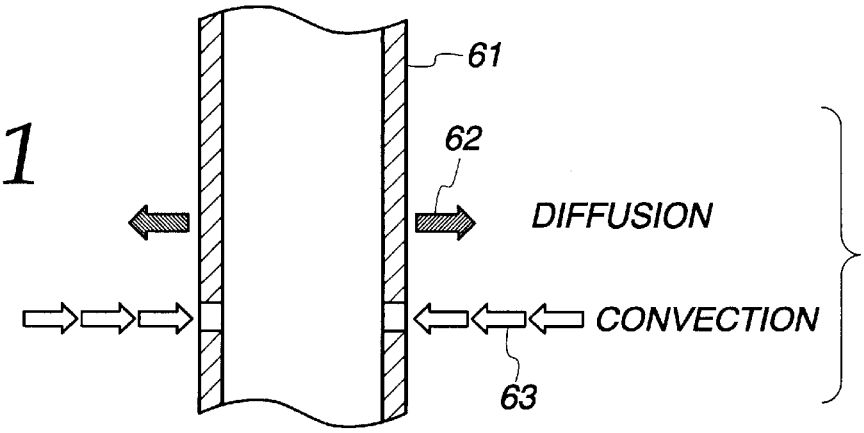
FIG. 1 illustrates the heat flow exterior to the casing by diffusion and convection.

A variety of casing heating systems has been proposed and some have been field tested with mixed results. To date, none of these systems take into account the heterogeneous nature of the oil deposit. Nor do they properly address the fundamentals of even an idealized casing heating process. Some of these ignored factors will be discussed. In FIG. 1, the casing heating processes are characterized by a heated perforated casing 61, that transfers heat into the deposit by thermal diffusion as suggested by the black arrows 62. The in-flowing liquids by convection transfer the heat back into the perforated casing as indicated by the open arrows 63. Thermal diffusion is slow and convection heat transfer can be more rapid. Because the ingressing liquids can more rapidly transfer heat back into the wellbore, the diameter of the heated zone around the perforated casing would be small, thereby limiting the size of the pay zone where the viscosity is substantially reduced by the increased formation temperature. However, the cooling effects by ingressing liquids on the production from casing heated wells can be mitigated by maintaining the temperature of the casing at the maximum allowable value. Production from casing heated wells that exhibit a skin effect near the well bore will also be less affected by ingressing cool liquids.

In addition to the external diffusion and convection, there are internal heat transfer mechanisms within the perforated production casing. These include mixing of the heat in liquids in region 67 from different segments of the perforated casing as suggested in FIG. 2. Also noted is that the heated casing also diffuses heat, as suggested by 65 into the upward flowing liquids 66. These upward flowing liquids may be already heated, and may be also further heated in the upper portion of the perforated casing. This suggests that even for an idealized uniform deposit and a casing system that is uniformly heated, that the upper portion of the perforated casing might rise to greater temperatures than the lower portions.

Figure 3:
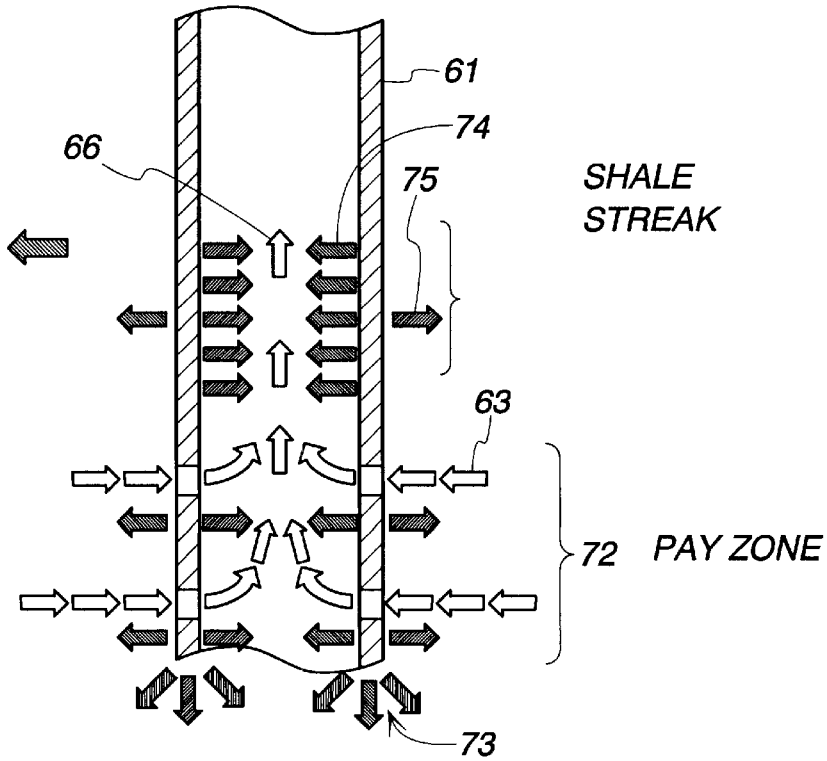
FIG. 3 illustrates the heat flow both within and without the casing and further considers the effects of a poorly producing zone after several weeks of heating.

FIG. 3 illustrates the case where the perforated casing penetrates a slowly producing zone, such as a shale streak 71 that overlays a high producing zone 72. After a few weeks of heating only a small proportion of heat 75 from the casing near the shale streak will be transferred into the shale. This is due, in part, because the ingressing liquids fail to transfer all of the heat back into the wellbore. The shale formation will tend to perform as a thermal insulator, and will rise in temperature such that most of the heat flow 74 from the casing will be re-directed back into the upward flowing liquids 66. This excess temperature rise is partially moderated by the upward flowing liquids from the more productive zones below the shale streak.

Assuming that higher casing temperatures the greater will be the increase in production. On this assumption, the optimum heating profile is one where the maximum allowable temperature is determined by the characteristics of the apparatus. In our case, this would be about 125° C. all along the eddy-current heating tool, assuming a 150° C. upper limit. On the other hand, economic factors may dominate in the event that the cost of additional heating is not offset by increased production.

One solution would be to conduct a detailed reservoir analysis that included heating of the casing. This would permit tailoring the heating profile along the casing to mitigate the above noted problems. This step can be time consuming and require a programmable method or a connection arrangement within the tool to fit the heating profile to the deposit. Further, well log data may be missing and may be unreliable.

The broader goal would be to increase the spatial distribution of the temperature of the casing to a predetermined spatial distribution. In the case of deposits that have about the same temperature viscosity characteristics, the temperature of the perforated casing could be uniformly increased throughout the deposit to the maximum allowable temperature, such as 125° C. or a smaller value as determined by economic considerations.

To do this, a temperature-sensing array along the casing heating system would be needed. Each sensor along or within the casing heating tool would sense the temperature of a short segment of the tool. This sensed temperature would then control the heating for that segment. By so doing, the temperature of each segment would not rise above a predetermined value. Further, it would modulate the dissipation in the casing in proportion to the ingressing liquids and the heat capacity of the liquids.

Figure 4:
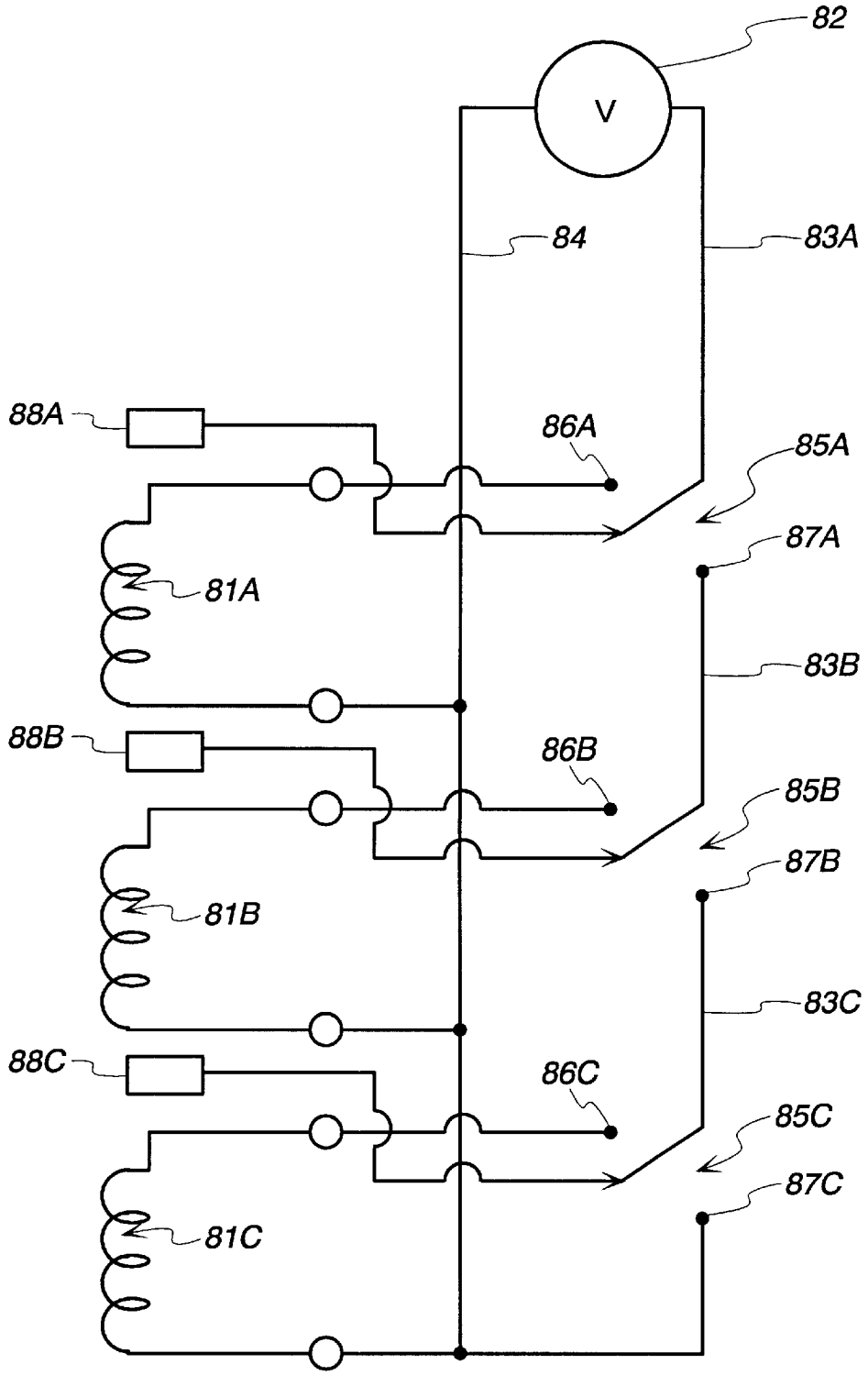
FIG. 4 illustrates how the heating from each of the eddy-current heating coils can be controlled by a temperature sensor that controls a simple switch.

A simple way would be to use temperature-sensing switches, such as shown in FIG. 4, 80. For illustration purposes, we show three coils 81*a,* 81*b,* and 81*c* of an eddy-current casing heating system. (Alternatively, the three coils could be the primary of downhole transformers used to supply ohmic-heating current to the casing walls.) A voltage source, V 82, excites cables 83*a* and 84. The switches 85*a,* 85*b,* and 85*c* are thermally actuated, to energize or de-energize the adjacent coil. For example, if switch 85*a* is connected to 86*a,* if coil 81*a* is to be excited. If the sensor 88*a* on the tool near coil 81*a* exceeds 125° C., then the switch 85*a* switches to position 87*a* thereby de-energizing coil 81*a,* while at the same time permitting coils 87*b* and 87*c* to be energized or de-energized by switches 85*b* and 85*c* as controlled by sensors near 87*b* and 87*c*.

The switches could either be mechanical or semiconductor. The semiconductor switches could either be switched on or off, similar to mechanical switch. Or they could be time modulated in a way that results in continuous feedback control.

Several other factors are needed to make this work. First, the heating capacity of each coil should be up to several times that required based on a simple average overall flow rate. This is necessary in the case where much of the production comes from just a few zones.

In addition, consideration should be given to the thermal diffusion properties of the barren formations above and below the pay zone. Such formations can have a very high electric conductivity and may also have a very high thermal conductivity. In the case of a thin low-conductivity pay zone sandwiched between tow very high thermal conductivity barren layers, it may be advantageous to heat the casing just within the barren layers. Because of the high thermal conductivity of the barren zones, additional heat could be transferred into the pay zone via the high thermal conductivity barren zone.

The liquids that flow within the casing can be used to transfer heat from the coils. This can be enhanced by having flow pathways both outside of the coils and within the coils. In addition, pathways into the interior of the coils from liquids adjacent the casing can be provided by inserting flow spaces between short length coils. This has not been considered before and will help cool the coils while enhancing the flow and mixing patterns.

The design of the power conversion unit must also be able to accommodate the expected variations in the load. Such variations would occur as each switch is turned on or off or where most of the production comes from just a few zones.

The optimized casing system should be far more effective than one without the optimization. The effectiveness will be sensitive to the heterogeneity of the deposit. It will be more reliable provided that suitable temperature switches or controllers can be installed for each coil group in the casing heating system.

The implementation of the above will be considered next in more detail. The ohmic heating apparatus will be first described in terms of heating just a single segment of the casing, this will be followed by showing how this is modified to heat different segments of the casing in a controlled manner.

Figure 5:
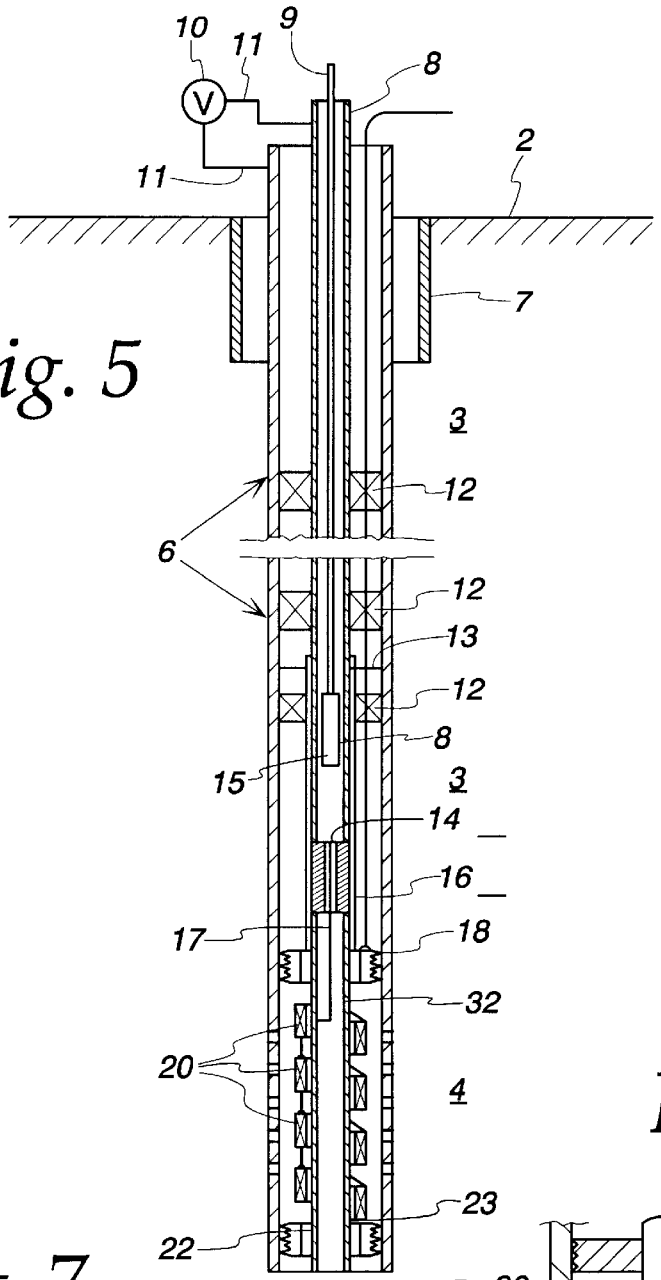
FIG. 5 is a simplified vertical cross-section view, partly schematic, of one embodiment of the invention comprising a casing wall ohmic current heating system which employs a matching transformer.

FIG. 5 illustrates a vertical cross-section of a vertical oil well with a transformer matching arrangement which matches the characteristics of the current flowing on the casing in the vicinity of the reservoir to the characteristics of the power delivery system. Shown here, the cross-section of an oil well originally completed using conventional means and a conventional recovery system without the casing system. The surface of the earth 2, the overburden 3, the reservoir 4, and the underburden 5 are penetrated by the conventional production casing system 6. Also shown is the surface casing 7. Conventional production tubing 8 along with the pump rod 9 are deployed from the upper part of the well system. The lower part of the tubing 8 is modified to accommodate the transformer matching system 18, 20, 21 and 23 in the lower part of the wellbore. The power is delivered via the tubing 8 and casing 6 by exciting these from a source 10 via cables 11 connecting the source to the casing 6 and the tubing 8. Non-conducting centralizers 12 are employed to prevent the tubing 8 from contacting the casing 6, which would otherwise short-out the circuit. The pump 15 is located below the surface 13 of the reservoir fluids. To prevent the conducting reservoir fluids from shorting out the tubing with respect to the casing, the tubing below the surface of the reservoir fluids is covered by an insulating layer 14. Just above the reservoir 4, the tubing 8 is interrupted by a tubular non-metallic (non-conducting) isolation section 16. The characteristics of this isolation section are such that the normal flow of fluid is not interrupted but the length of the isolation section serves to isolate the energized tubing from the conducting packer 18. The current is taken from the energized tubing 8 via a conductor 17 which is attached to one of the conductors of the toroidally wound transformer assembly 20. The current flows via conductor 17 through the primary of the toroidally wound sections and then flows via cable 23 into the lower conducting packer 22.

Figure 2:
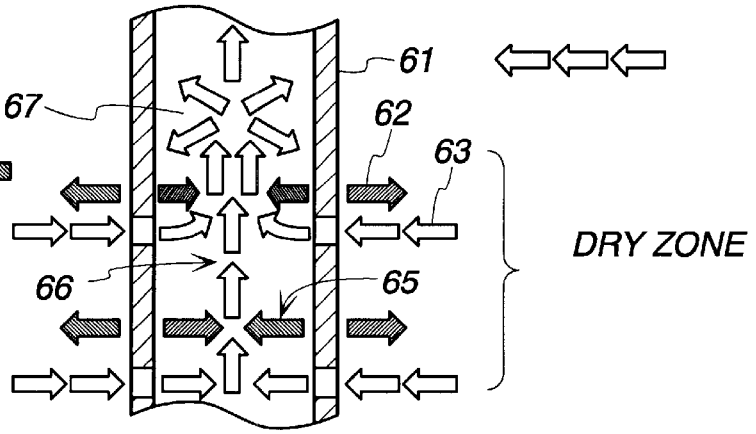
FIG. 2 illustrates the heat flow both without and within the casing.
Figure 6:
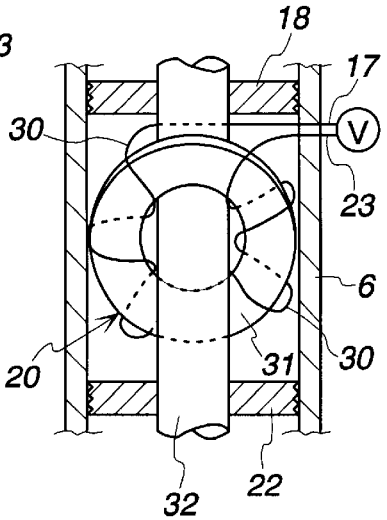
FIG. 6 is a conceptual drawing which illustrates the functions of the downhole matching transformer and other ohmic current apparatus in the system of FIG. 1.

FIG. 6 provides conceptual details on how the toroidally wound cores form a transformer action which drives current into the casing (or screen) 6 in the immediate vicinity of the reservoir. The voltage appearing between the lower portion of the tubing 32 and casing 6 drives the current into the toroidal winding assemblies via conductors 17 and 23. The cores are toroids formed from thin ferromagnetic sheets (e.g., 5 mil. thickness), such as Selectron, manufactured by Allegheny-Ludlum, and rolled into the form of a toroid 31. The windings 30 on the toroid 31 are chosen to have sufficient number of turns so as to transfer the impedance of the casing wall to a value appropriate for high delivery efficiency and design robustness. Within the inner portion of the toroids, as shown in FIG. 5, the single-turn secondary of the transformer is formed by the highly conducting tubing such as an aluminum tube coated with a resistant corrosion surface. This conducting tubing 32 is then in direct ohmic contact with the upper conductive packer 18 and the lower conductive packer 22 (FIG. 2). The conductive packers 18 and 22 contact the casing 6 just below the overburden 3 and just above the underburden 5 (FIG. 5). The single-turn secondary of the transformer 20 is therefore formed by the aluminum tube 32, the conducting packers 18 and 22, and the walls of the casing 6 in the immediate vicinity of the wellbore. The surface electrical impedance of the casing 6 between the packers is larger than the impedance of the packers and tubing, but does present a very low impedance to the secondary winding. This low impedance must be transformed up to an impedance in the order of a few ohms or more so as to obtain suitable power delivery efficiency. This is done by properly choosing the number of turns on the primary of the toroidal winding.

Figure 7:
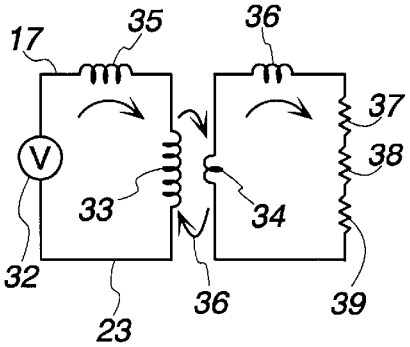
FIG. 7 is a circuit diagram illustrating how the matching transformer functions in relation to other electrical circuit elements.

FIG. 7 illustrates the electrical circuit equivalent for the transformer conceptually illustrated in FIG. 6. The voltage source 32, via the conductors 17 and 23 energizes the primary of the transformer, which is comprised of a leakage inductance 35 and a mutual primary inductance 33 which couples to the mutual secondary winding inductance 34 via the changing flux 36. The single-turn secondary loop is comprised of the secondary winding 34, a leakage inductance 36, the resistance 37 of the tubing, the resistance 38 of the conductive packers, and the resistance 39 of the casing.

In order to obtain a proper match between the electrical characteristics of the secondary circuit which is dominated by the impedance of the casing, and the power delivery system, the very low impedance of the casing 6 near the reservoir 4, (FIG. 5) must be transformed up to a value in the order of a few ohms or greater. This can be done by employment of silicon steel tape wound cores 31 which have a very high permeability and a relatively high electrical resistance; by virtue of being wound as a tape, such cores are also laminated to ensure reduction of eddy-current losses. The use of the high permeability of the steel core with a small air-gap causes the flux that links the primary of the transformer to link the secondary, thereby minimizing the leakage inductances 35 and 36, (FIG. 7). Should the leakage inductance be too high, excessive reactance would be introduced into the input leads 17 and 23, which would result in a poor power factor. However, the design, as previously discussed, avoids the poor power factor problem by the use of high permeability silicon type steel cores. The impedance of the casing 6, as measured for typical installations of about ten to twenty feet, would probably be in the order of a few tenths of a milliohm up to a few milliohms, depending on the length of the casing to be heated and the operating frequency. This low impedance has to be transformed up to something in the order of a few ohms, at least greater than one ohm to assure an adequate power delivery efficiency with typical commercial cables or tubing power delivery arrangements. Since the transformed impedance is proportional to the square of the turns ratios, the number of turns on the primary should be approximately twenty to five hundred turns, depending on the desired operating impedance levels.

A (single-segment) system as described in FIGS. 5, 6 and 7 can be retrofit into existing wells as well as being installed in new wells of conventional design. To retrofit a well, the existing tubing system is removed and a downhole tubing system arrangement like that shown in FIG. 5 is lowered into the well. The system is installed by positioning the transformer assembly and casing heating system in the immediate vicinity of the wellbore as illustrated in FIG. 1 with a conducting packer 18 near the top of the zone to be heated and a conducting packer 22 in the immediate vicinity of the lower portion of the zone to be heated. These conducting packers are then installed by expanding the steel teeth of the tubing anchor into the steel of the casing 6. Depending on the amount of power to be transferred and the length of the zone to be heated, one or more of such toroidal transformers, as shown in FIG. 2, would be needed to provide the necessary energy to conduct the heating.

FIG. 8 provides a three-dimensional conceptual drawing wherein a portion of the casing 6, has been removed to show the principal downhole portions of the system, which include the upper conducting packer 18, one of the primary transformer assemblies 30, 31, and 20, and the lower conducting packer 22. The tubing 8, as it enters into the immediate vicinity of the reservoir, is insulated by an insulating sheath 14. However, as this sheath approaches the vicinity of the wellbore, the metallic portion of the tubing and the sheath is replaced by a non-conducting fiber-reinforced tubing 16 which is attached to the upper conducting packer 18. The conductor 17, which is attached to the metallic portion of the tubing 8 at 17*a,* is routed through the fiberglass tube 16 to attach to one of the primary leads of the toroidal transformer. The second lead 23 from the transformer is attached to the lower conducting packer 22. A highly conducting tube 32 is ohmically attached to the upper conducting packer 18 and the lower conducting packer 22. The tubing 21, the packer 18 and 22, and the casing wall 6 comprise the components in the secondary circuit of the transformer 20.

Figure 9:
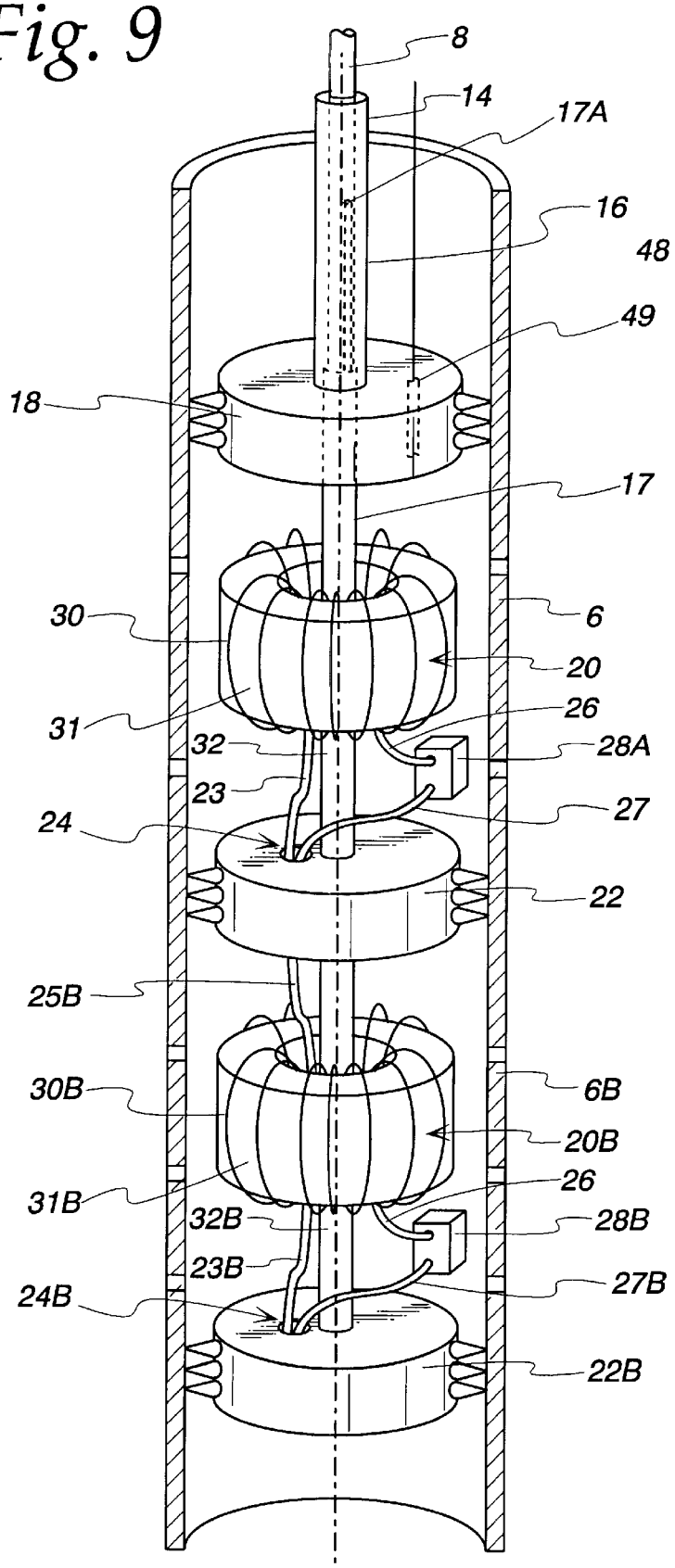
FIG. 9 is a three-dimensional characterization of the downhole ohmic heating system that includes a temperature controlled switch.

FIG. 9 is a three-dimensional characterization of how a multi-segment ohmic casing heating system could be implemented. The components 20*b*, 22*b*, 23*b*, 25*b*, 26*b*, 27*b*, 28*b*, 30*b*, 31*b* and 32*b* are duplicates of similar numbered components in the upper portion of the FIG. 9. Insulated conductor 17 is used to connect with first-lead to the winding on the toroidal core. Insulated conductor 26 is used to connect the upper insulated terminal of the switch 28 to conductor 17. Insulated conductor 27 is used to connect the lower insulated terminal of the switch 28 to the second-lead to the winding 25 on the toroidal core 20. Similarly, the first-lead to the winding 25*b* is connected to the upper part of switch 28*b* via insulated cable 26*b*. The second-lead 23*b* to the winding on toroidal core 20*b* is connected to the lower port of switch 28*b* via insulated cable 27*b* and also to conducting packer 22*b*. Temperature sensitive switches 28 and 28*b* present an open circuit to the switch terminals when the temperature is below the critical limit. If the temperature exceeds the limit, for example the switch 28 will close, thereby de-energizing the primary on core 20 but at the same time allowing the winding on core 20*b* to remain energized.

The cable 18 and the sensor package 49 are attached to the uppermost conducting packer. Similar installations of sensor and cables can be inserted on other conducting packers as well. These sensor could supply auxiliary temperature data or pressure data to assist in the operation of the apparatus.

FIGS. 10 and 11 illustrate another version of the casing wall heating system of this invention. This version again relies on a combination of a downhole casing wall heater system which is integrated with the power delivery system such that good efficiency is realized.

FIG. 10 presents a conceptual design of an eddy-current casing wall heater 47. This system is comprised of a power cable delivery system including the cables 41 and 44, a matching system such as a capacitor 42, and the windings 43 on a field pole 46. The field pole 46 is like the rotor from a synchronous motor/generator. By energizing the windings 43 on the field pole system 46, magnetic flux is created which tends to pass through the casing wall, from one pole to the other. This creates a flow of eddy-currents in the wall, which in turn converts the energy in the electrical field into thermal energy in the wall of the casing 6.

FIG. 11 is another schematic of a vertical cross-section of a conceptual design of the eddy-current heating system as applied to a cased-hole completion. This shows a conventional oil well which penetrates the surface 2 of the earth, through the overburden 3, into the reservoir 4, and then into the underburden 5. This well is conventionally installed with the emplacement of the surface casing 7 and then subsequently boring a hole of sufficient diameter to lower the production casing 6 into the well. This production casing is then cemented to the earth, and the well is completed by means of a perforating gun to form perforations 19 into the reservoir.

To install the retrofit system, the conventional tubing system may be unaltered and the eddy-current heating tool slipped down the tubing as shown in FIG. 11. A source of electrical power 10 is connected via cable 11 to the production casing 6 and to an insulated cable 41. This cable 41 is attached to a matching element 42, usually a capacitor, which in turn is connected to the windings 43 on a field pole 46. A space between the pole piece 46 and the casing 6 exists to allow insertion of the tool. A conducting packer 45 is used to terminate the well tubing 8 and to anchor it. The other winding 44 can be attached to the conducting packer 45 or, as an alternative (not shown), can be returned by an additional conductor in cable 41 to the surface and grounded at the casing head.

Figure 12:
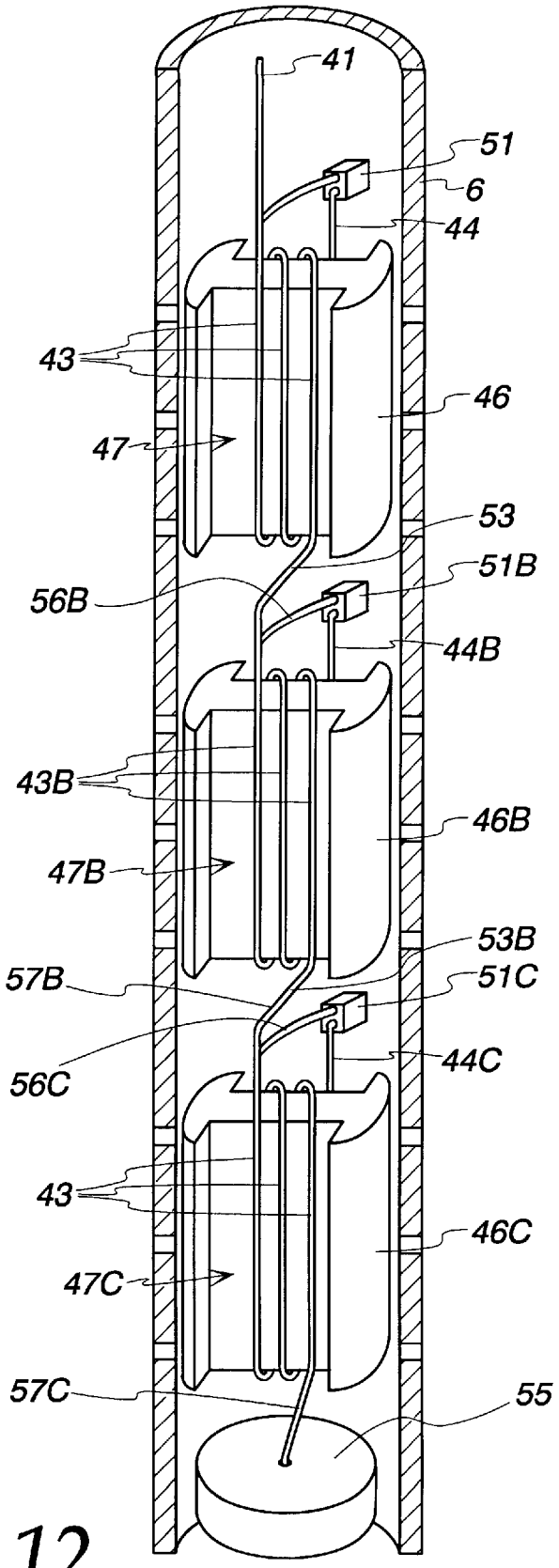
FIG. 12 is a three-dimensional characterization of a multi-coil eddy-current heating system that includes a temperature controlling switch for each of the coils.

FIG. 12 illustrates a three-dimensional characterization of a multi-segmented eddy-current casing heating system. This was derived from the arrangement shown in FIG. 10. Similar to FIG. 12, additional windings 43*b* and 43*c* and cores 46*b* and 46*c* are added. In addition, three single-pole temperature controlled switches 44, 44*b*, and 44*c* were added. Insulated cable 41 that is energized from the surface is attached to the first lead to the winding on the magnetic core 47. The second lead from the winding on the core 47 is attached via an insulated cable 57 to the first lead to the winding on the second magnetic core 47*b*. Similarly, the second lead from the winding on the core 47*b* is attached via an insulated cable 57*b* to the first lead to the winding on the core 47*c*. Similarly, the second lead from the winding on the core 47*c* is attached via an insulated cable 57*c* to a conducting packer 55.

Current is supplied from the power conditioning unit (PCU) on the surface via insulated cable 41 and flows through all of the windings and then into the conducting packer 55. The current then returns to the surface via the casing.

The upper insulated terminal and the single pole temperature controlled switches 51, 51*b* and 51*c* are connected via insulated cables 56, 56*b* and 56*c* to the first lead to the windings on cores 57, 57*b* and 57*c*. The second insulated terminal on the switches 51, 51*b* and 51*c* is connected via insulated cables 44, 44*b* and 44*c* to the second lead from the windings on cores 57, 57*b* and 57*c*. In the event that an excessive temperature is sensed by one of the switches, this switch will close, thereby de-energizing the associated winding. At the same time, current will still be supplied to the remaining windings that are not experiencing excessive temperatures.

The single pole switch shown in FIGS. 9 and 12 can result in placing a short circuit to the PCU at the surface, if all switches are activated by excessive temperatures. This can be tolerated if the PCU has short circuit sensing cutoff controls and a pre-programmed restart procedure.

The cable 18 and the sensor package 49 are attached to the uppermost conducting packer. Similar installations of sensor and cables can be inserted on other conducting packers as well. These sensors could supply auxiliary temperature data or pressure data to assist in the operation of the apparatus. Alternatively, the activation of control switches 28 and 28*b* could be made via hardwire telemetry controls located at the surface.

Figure 13:
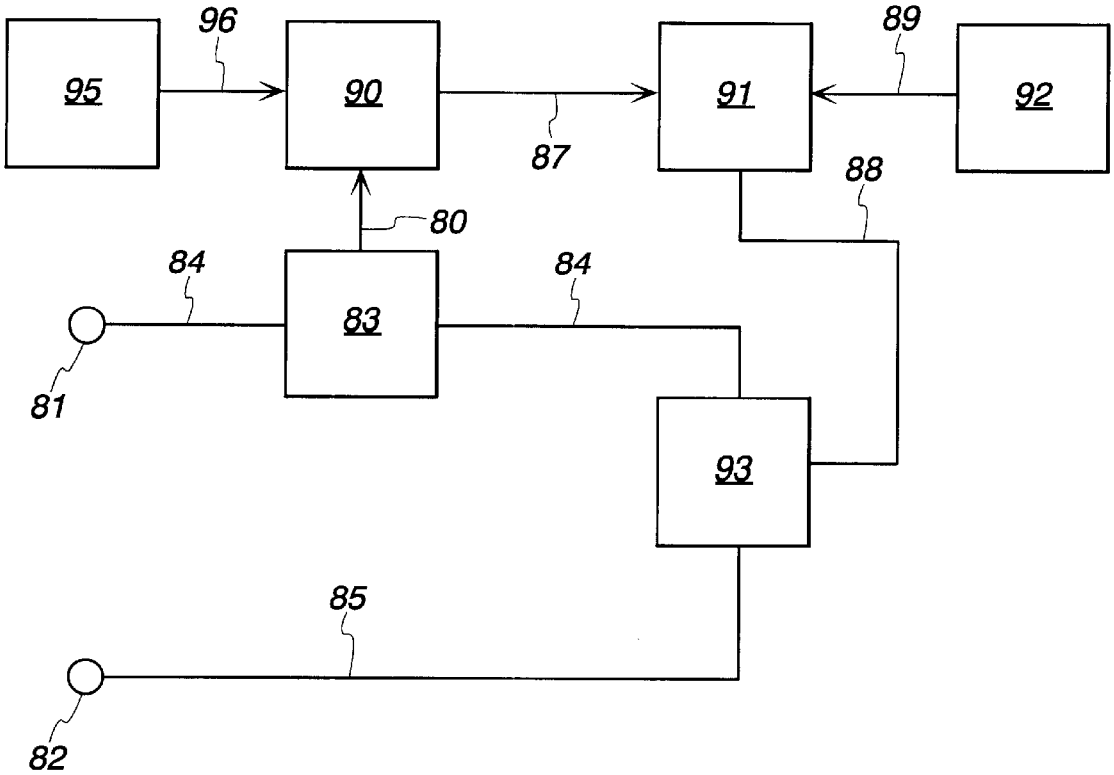
FIG. 13 illustrates a temperature controlling switch with provision for hysteresis.

FIG. 13 illustrates a functional diagram of the single-pole switch. The switch terminals 81 and 82 are connected to high current insulated conductors 84 and 85. These conductors carry the excitation current through the switch element 93, when this switch is closed in response to excessive temperature. The switch 93 could be a simple bi-metallic switch which closes when experiencing excessive temperatures. The switch would also open after the switch material cooled down. The difficulty is that the switch may have limited life and may introduce high voltage transients if open during the peak of the current flow. Rapid opening and closing of these switches can be reduced by adding metal around the bi-metallic switch. This would increase both the heat-up time to open the switch as well as the cool-off time needed to allow the switch to re-close.

These difficulties can be addressed by using semiconductor devices, such as a Triac or the SCR (silicon controlled rectifier) equivalent to the Triac. In either case, these devices interrupt the current during the zero crossing of the current flow, when the current is very small. This eliminates the transient impulse and these devices can be interrupted or switched on or off many times. To provide gate on or firing signals to close the switch 93, an electronic power supply 90 provides operational power, via cable 87, to a firing circuit 91. The firing circuit is controlled by the temperature sensor 92 via cable 89. Via cable 88, firing or gate on signals are supplied to switch 88. When the switch is off, the power for the firing circuit is supplied from a small coil 95 that picks up the leakage fields from the nearby eddy-current coil and this pickup is used to energize the power supply 90 via cable 96. If the switch is closed, the fields from the eddy-current coils are absent, but current now flows through cables 84 and 85 because the switch 93 is closed. By means of the current transformer 83, some of the power from the current flowing in cable 84 can be used to provide an energy source via cable 86 for the power supply circuit 92.

If good reservoir data is available, the heating profile of the producing zone can be pre-programmed for the initial start up phase. Existing reservoir software programs that embody electrical heating effects can be used for this purpose. These take into account the traditional reservoir properties, the energy dissipation in the casing, screen or adjacent formations. These also take into account the thermal properties, such as heat capacity, diffusion and convection. From such data the power requirement to each segment can be estimated in terms of the heat transfer capacity of the adjacent formation and of the liquids recovered over a defined segment at a given temperature and measurement point. A simple case is where the temperature measurement point is at the wellhead. Here the temperature of the produced liquids would be monitored and used to control the overall power such that the calculated temperature at any given point is within expected limits. Or, a more complex series of temperature measurements points along the producing zone could be used, where the temperature of the liquids is aggregated from two or more distinct regions that have different reservoir characteristics. In this case, the power to the group segments would be controlled by measuring the temperature at one point within the grouped segments. By so doing, it may be possible to combine the number of independent heating segments and thereby simply the design.

FIG. 9 can be used to show how this technique can be implemented. The thermal transfer characteristics for the section of the reservoir between conducting packers 18 and 22 are estimated based on reservoir data. Next, the thermal transfer characteristic of this section are calculated to achieve a given temperature increase. From this, the rate of the ingressing liquids, the rate of heat lost to the ingressing liquids and rate of heat lost by diffusion into the reservoir are calculated. The sum of these heat rates is the power required to heat the section between packers 18 and 22 for a flow rate equal to the rate of the ingressing liquids. Next the turn ratio of the windings 30 on the toroidal core 31 are adjusted to supply the required power dissipation in the casing for a specific primary voltage excitation tot he transformer. This process is repeated for the section between conducting packers 22 and 22B. From these data, the total flow rate and power input can be estimated for a given temperature rise along the casing. By combining two or more sections, the number of temperature measurement points can be reduced. For example, the temperature measurement point 49 measures the temperature of the liquids from both sections, thereby reducing the complexity of the down hole equipment. Since the fraction of the liquids produced from the lower section is reasonably predictable based on the reservoir analyses, measuring the temperature in the top packer is a reasonable method to control the electrical power input to realize a given temperature increase. This technique may be valuable for long completions. This may be especially true, in the case of many long, 500 foot or more long horizontal completions, where the variations of the reservoir properties are small over many long intervals. Over the length of such horizontal wells, there may be rare but abrupt discontinuities in the formation. These may require different heating rates on either side of such a discontinuity. To simplify, it should be possible to combine the smaller segments into longer but not always equal segments that span formations with similar properties. By so doing, the number of discrete segments can be reduced, thereby simplifying the design.

On the other hand, such simplification may not always be practical. Consider a 50 foot vertical completion in a formation where the heat into and out of the formation can vary widely over any 10 foot interval as a function of depth. Hence, the length of each controllable section of the casing should be in the order of 10 feet. Where such a wide variation over short intervals occurs, it is imperative to measure the temperature near each 10 foot segment so as to realize a predetermined temperature distribution along the well bore.

To one skilled in the art other versions are possible. For example, the on-off function of the circuit shown in FIG. 13, can be replaced by one that can continuously control the current to the eddy-current excitation coils. Alternatively, power to each of the eddy-current coils can be controlled at the surface via telemetry systems that monitor the temperatures along the tool and use these data to control the current supplied to each of the eddy-current coils. If good reservoir data is available, such as for a new horizontal well, the heating profiles can be pre-programmed for the initial start up phase.

In addition, it should be noted that the spatial distribution of temperature along the casing will be different than the spatial distribution of the temperature along the tool. Such variations will tend to be suppressed by the application of the design criteria discussed here. If needed, sensors could be placed in contact with the casing to assure that the temperature of the casing does not exceed a predetermined value.

What is claimed is:

1. An electrical heating method for mineral wells, comprising a bore hole, a well casing, a metallic fluid admission section located adjacent a hydrocarbonaceous-reservoir of a heterogeneous reservoir that has at least two longitudinally spaced producing intervals that have different thermal heat transfer characteristics, comprising the steps of:

providing a downhole electrically energized heater having at least two independently controlled heating elements spaced apart longitudinally from each other, positioning at least one of said heating elements near a first of said producing intervals adjacent said fluid admission section, positioning a second of said heating elements near a second of said producing intervals adjacent said fluid admission section, supplying electrical energy to each of said heating elements to increase the temperature of the producing interval near each of said heating elements, measuring the temperature adjacent each of said heating elements, and controlling the quantity of electrical power supplied to each of said heating elements in accordance with the thermal transfer characteristic of each of said producing intervals to realize a specified temperature near each of said heating elements.

2. The method of claim 1 in which the specified temperature near each of said heating elements is the same.

3. The method of claim 2 in which the specified temperature near each of said heating elements does not exceed a safe limit.

4. The method of claim 3 in which said safe limit is no greater than 150° C.

5. The method of claim 1 in which the temperature of said producing zone near each of said heating elements is increased by magnetic excitation of each of said heating elements.

6. The method of claim 5 in which the temperature of said producing zone near each of said heating elements is increased by inducing eddy currents in said metallic fluid admission section.

7. The method of claim 6 in which the distribution of energy to each of said heating elements is controlled by electrical circuits in accordance to the desired temperature distribution along each of said producing intervals.

8. The method of claim 6 in which the distribution of energy to each of said heating elements is controlled by mechanical electrical switch in accordance to the desired temperature distribution along each of said producing intervals.

9. The method of claim 6 in which the distribution of energy to each of said heating elements is controlled by electronic circuits in accordance to the desired temperature distribution along each of said producing intervals.

10. The method of claim 1, in which the length of each of said heating elements is chosen such that the sum of the lengths of each of said heating elements is smaller than the length of said metallic fluid admission section.

11. An electrical heating system for thermally enhancing oil well flow rates of hydrocarbonaceous fluids through a metallic fluid admission section in a well casing located adjacent a hydrocarbonaceous fluid producing zone of a heterogeneous fluid reservoir, comprising:

a downhole electrically energized heater having at least two independently controlled heater elements, said heater positioned in said well casing near said metallic fluid admission section, electrical conductors connecting a source of electrical energy located above the ground near the top of said well to said heater elements to independently supply energy to each of said heater elements, a temperature sensor for each of said heater elements to measure the temperature adjacent each of said elements, and a control for varying the quantity of electrical energy supplied to each of said heater elements in accordance with a specific temperature near each of said heater elements.

12. The electrical heating system of claim 11 in which each of said heater elements includes magnetic excitation means having a magnetic core and a multi-turn electrical input winding.

13. The electrical heating system of claim 12 in which said magnetic excitation means includes a multi-turn output winding.

14. The electrical heating system of claim 13 in which said magnetic excitation means provides transformer action to heat said casing adjacent each of said heater elements.

15. The electrical heating system of claim 12 in which said magnetic excitation means generates an alternating current magnetic field in said casing adjacent each of said heater elements.

16. The electrical heater system of claim 12 in which said magnetic excitation means includes a field pole and windings which magnetically create eddy-currents in said casing when said windings are energized.

17. An electrical heating method for mineral wells, comprising a bore hole, a well casing, a metallic fluid emission section located adjacent a heterogeneous hydrocarbonaceous reservoir that includes a plurality of longitudinally space producing intervals, each of said producing intervals having different thermal heat transfer characteristics, said method comprising the steps of:

providing a plurality of downhole independently controlled heating elements spaced apart longitudinally from one another along said longitudinally space producing intervals, positioning at least one of said plurality of heating elements near each of said plurality of producing intervals, calculating the quantity of electrical energy to be supplied to each of said heating elements to increase the temperature of its respective producing interval to achieve a specific temperature near each of said heating elements based on a computer analysis of the reservoir characteristics, and supplying electrical power to each of said heating elements to achieve said calculated temperature near each of said heating elements.

18. The electrical heating method of claim 17 including the step of measuring the temperature near at least one of said heating elements.

19. The electrical heating method of claim 18 including the steps of:

identifying groups of adjacent producing intervals having similar reservoir characteristics, and measuring the achieved temperature near only one of said heating elements in each of said group of producing intervals to determine the actual realized temperature.

20. The method of claim 18 in which the step of measuring the achieved temperature near at least one of said heating elements is accomplished by measuring the temperature of the produced liquids.

21. The method of claim 18 in which the step of measuring the achieved temperature near at least one of said heating elements is measured by measuring the temperature near the casing.

22. The method of claim 17 including the step of measuring the temperature of the produced liquids.

* * * * *